US006553207B2

(12) United States Patent
Tsusaka et al.

(10) Patent No.: US 6,553,207 B2
(45) Date of Patent: Apr. 22, 2003

(54) IMAGE FORMING APPARATUS CAPABLE OF SINGLE-SIDED AND DOUBLE-SIDED PRINTING

(75) Inventors: Shusaku Tsusaka, Nagoya (JP); Yoshiteru Hattori, Bisai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/946,547

(22) Filed: Sep. 6, 2001

(65) Prior Publication Data

US 2002/0039508 A1 Apr. 4, 2002

(30) Foreign Application Priority Data

Sep. 29, 2000 (JP) ..... 2000-298146

(51) Int. Cl.[7] ..... G03G 15/00
(52) U.S. Cl. ..... 399/401; 399/405
(58) Field of Search ..... 399/401, 402, 399/405

(56) References Cited

U.S. PATENT DOCUMENTS 4,750,016 A * 6/1988 Kusumoto et al. ..... 399/405
5,111,252 A * 5/1992 Hamada et al. ..... 399/405 X
5,184,734 A * 2/1993 Yamaguchi ..... 399/405 X
5,202,736 A * 4/1993 Komurasaki ..... 399/405
5,241,353 A * 8/1993 Maeshima et al. ..... 399/405
5,448,348 A * 9/1995 Azeta ..... 399/401 X
5,953,575 A * 9/1999 Park et al. ..... 399/401
6,185,381 B1 * 2/2001 Nakahara et al. ..... 399/401 X

* cited by examiner

*Primary Examiner*—Fred L. Braun
(74) *Attorney, Agent, or Firm*—Oliff & Berridge, PLC

(57) ABSTRACT

An image forming apparatus and a method of forming an image by the image forming apparatus that includes an image forming unit for forming an image onto a recording medium, a supply path for supplying a recording medium to the image forming unit, a first discharge path for discharging the recording medium, a return path, connected with the first discharge path, for returning the recording medium to the image forming unit, a second discharge path, substantially parallel with the supply path, for discharging the recording medium, and a guide member movable from a first position to create the first discharge path and the return path to a second position to create the second discharge path.

26 Claims, 3 Drawing Sheets

IMAGE FORMING APPARATUS CAPABLE OF SINGLE-SIDED AND DOUBLE-SIDED PRINTING

BACKGROUND OF THE INVENTION

1. Field of Invention

The invention relates to an image forming apparatus including a face-up sheet discharging function for discharging a single-sided printed sheet with a printed side thereof facing up, and a double-sided printing function for printing images on both sides of a recording medium.

2. Description of Related Art

A known image forming apparatus includes a double-sided printing function for printing an image on both sides of a recording medium. When the double-sided printing is performed in the image forming apparatus, the recording medium is discharged with a side of the recording medium which is printed first facing up and with the other side thereof printed next facing down.

For double-sided printing, a reverse feeding path is required in a rearward position of a fixing unit, to reversely feed the recording medium having an image printed on one side thereof, back to the image forming unit to form an image on the other side of the recording medium.

When an image is formed on a side of a special recording medium, such as thick paper like cardboard, it is required to feed and discharge such special recording medium, with the printed side thereof facing up, through a generally straight discharge path. If the discharge path has a turn, it is difficult to feed the recording medium of the cardboard through the turn, thus inhibiting the printing of an image on the cardboard.

To form a generally straight discharge path, a rear-side plate of the image forming apparatus disposed downstream of the fixing unit in a feeding direction of the recording medium is structured to open or close. When an image is formed on the special recording medium, such as cardboard, the rear-side plate of the image forming apparatus is opened to ensure the generally straight discharge path. The recording medium is discharged onto the rear-side plate after an image is printed thereon.

As described above, the reverse feeding path is required in the rearward position of the fixing unit for double-sided printing. In addition, a generally straight discharge path is required in a rearward position of the fixing unit for printing on the special recording medium, such as cardboard. Requirements of the reverse feeding path for double-sided printing and the generally straight discharge path for printing on the special recording medium cannot be satisfied at the same time.

SUMMARY OF THE INVENTION

The invention provides an image forming apparatus including a face-up sheet discharging function for discharging a single-sided printed sheet with a printed side thereof facing up, and a double-sided printing function for printing images on both sides of a recording medium.

In various embodiments of the image forming apparatus, the image forming apparatus comprises an image forming unit for forming an image onto a recording medium, a supply path for supplying a recording medium to the image forming unit, a first discharge path for discharging the recording medium, a return path, connected with the first discharge path, for returning the recording medium to the image forming unit, a second discharge path, substantially parallel with the supply path, for discharging the recording medium, and a guide member movable from a first position to create the first discharge path and the return path to a second position to create the second discharge path.

In various embodiments of a method of forming an image by an image forming apparatus, the method comprises the steps of supplying a recording medium to the image forming apparatus, forming the image onto the recording medium, and discharging the recording medium to either a first discharge path, a return path connected with the first discharge path or a second discharge path substantially parallel with the supply path, wherein a guide member is movable from a first position to create the first discharge path and the return path to a second position to create the second discharge path.

BRIEF DESCRIPTION OF THE DRAWINGS

An exemplary embodiment of the invention will be described in detail with reference to the following figures wherein.

DETAILED DESCRIPTION OF PREFERRED EMBODIMENTS

An exemplary embodiment of the invention will be described in detail with reference to the figures.

Figure 1:
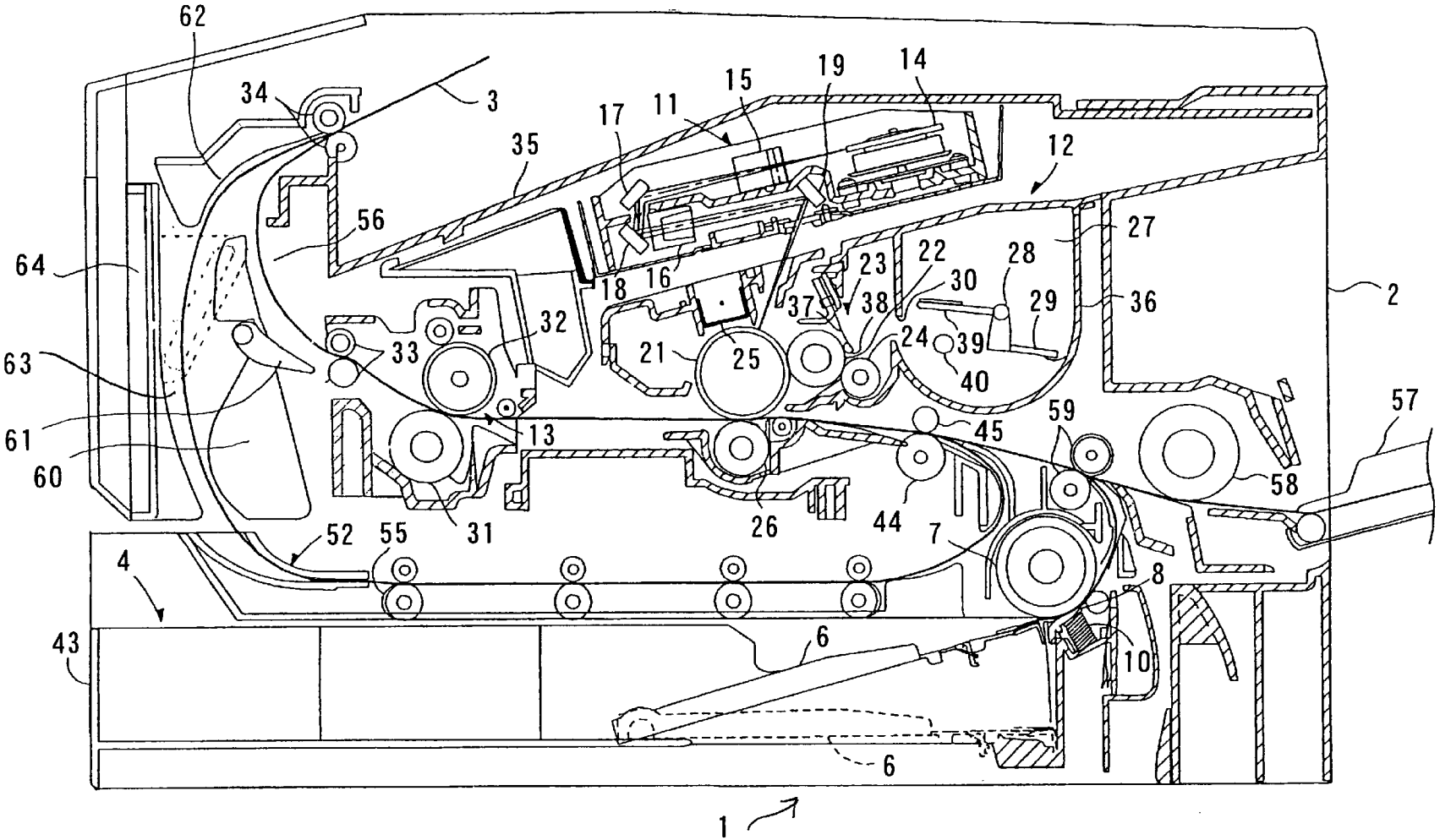
FIG. 1 is a side cross-sectional view of a laser beam printer according to an exemplary embodiment of the invention.

Referring to FIG. 1, configurations of a laser beam printer 1 will be described below. As shown in FIG. 1, the laser beam printer 1 is provided in a case 2 with a feeder unit 4 that feeds sheets 3 of paper. The feeder unit 4 includes a sheet tray 43 that accommodates the sheets 3 therein, a sheet pressure plate 6 that is pressed by a spring (not shown) and pivots as shown by solid lines and dashed lines in FIG. 1, a pick-up roller 7, a separation pad 8, and a spring 10 that urges the separation pad 8. The sheet pressure plate 6 presses the sheets 3 against the pick-up roller 7. By the rotation of the pick-up roller 7, the topmost sheet 3 is separated and picked up by the separation pad 8 and the pick-up roller 7. The sheet 3 is fed at a predetermined timing.

First sheet supply rollers 59 are disposed downstream of the pick-up roller 7 in a sheet feeding direction. A pair of register rollers 44, 45 are rotatably supported downstream of the first sheet supply rollers 59 in the sheet feeding direction. The sheet 3, picked up by the pick-up roller 7, is fed by the first sheet supply rollers 59 to the pair of the register rollers 44, 45, while making a U-turn. The register rollers 44, 45 feed the sheet 3 at a predetermined timing to an image transfer position between a photosensitive drum 21 and a transfer roller 26.

The photosensitive drum 21 is formed of an organic photosensitive member including positively chargeable polycarbonate as a main ingredient. More specifically, the photosensitive drum 21 includes a tubular aluminum sleeve, as a main drum, and a hollow drum having an approximately 20-mm-thick light-sensitive layer including a light-sensitive resin dispersed in polycarbonate, formed on an outer surface of the tubular sleeve. The photosensitive drum 21 is rotatably supported in the case 2, with the tubular sleeve electrically grounded. The photosensitive drum 21 is driven to rotate in the clockwise direction by a driving unit (not shown).

A charger 25 is a scorotron charger that uniformly and positively charges the surface of the photosensitive drum 21 by generating corona discharge from a tungsten wire.

A scanner unit 11 includes a laser beam generator (not shown) that generates a laser beam to form an electrostatic latent image on the photosensitive drum 21, a polygon mirror (pentahedron mirror) 14 that is driven to spin lenses 15, 16, and reflecting mirrors 17, 18, 19.

In a developing unit 12, a toner containing chamber 27 is formed in a case 36. In the toner containing chamber 27, an agitator 29 and a cleaner 39 are rotatably supported by a rotating shaft 28. The toner containing chamber 27 contains a positively chargeable non-magnetic single component toner having electrical insulation capacity. In a side wall of the toner containing chamber 27, which is disposed on an end side of the rotating shaft 28, a light penetration window 40 is provided. The agitator 29 agitates the toner in the toner containing chamber 27 by the rotation thereof. The cleaner 39 wipes the window 40 as the cleaner 39 rotates.

Formed adjacent to the toner containing chamber 27 to a side of the photosensitive drum 21 is a developing chamber 23 that communicates with the toner containing chamber 27 through an opening 30. A toner supply roller 24 and a developing roller 22 are rotatably supported in the developing chamber 23. The toner on the developing roller 22 is thin layered with a thin-plate-like elastic blade 37 regulating a thickness thereof to a predetermined amount.

The developing roller 22 includes a core metal formed of a stainless steel, a tubular base that is formed of conductive silicone rubber including conductive fine carbon particles and provided on the core metal, and a layer which covers the tubular base with a resin material or a rubber material including fluorine. The tubular base of the developing roller 22 may be formed of conductive urethane rubber other than the conductive silicone rubber.

The blade 37 includes a supporting portion formed of iron or stainless steel, a plate spring formed of phosphor bronze or stainless steel, and a contact portion 38 formed of silicone rubber and provided at one end of the plate spring.

Positively chargeable non-magnetic single component toner contained in the toner containing chamber 27 includes toner particles formed of styrene-acrylic-based resin in a spherical shape using a suspension polymerizationm method, to which a known coloring material, such as a carbon black, and a charge controlling agent, such as nigrosine, triphenylmethane, and quaternary ammonium salt, are added. A toner particle size is approximately 6 to 10 mm with an average toner particle size of 8 mm. Furhtermore, silica is added to a surface of the toner particle.

The transfer roller 26 is rotatably supported. The transfer roller 26 is formed of a conductive foam material having elasticity, such as silicone rubber and urethane rubber. A voltage is applied to the transfer roller 26 to transfer the toner on the photosensitive drum 21 onto the sheet 3.

A fixing unit 13 is provided downstream of a pressing portion where the photosensitive drum 21 and the transfer roller 26 are pressed against each other, in the sheet feeding direction. The fixing unit 13 includes a heat roller 32 and a pressure roller 31. The toner transferred onto the sheet 3 is fixed thereon with the heat and pressure applied while being fed by the heat roller 32 and the pressure roller 31.

A pair of second sheet supply rollers 33 disposed downstream of the heat roller 32 and the pressure roller 31 in the sheet feeding direction. A sheet guiding tray 60 is provided downstream of the second sheet supply rollers 33 in the sheet feeding direction.

As will be described below, the sheet guiding tray 60 is rotatably provided. When the sheet guiding tray 60 is in a position shown in FIG. 1, a discharge path 56 is formed to guide the sheet 3 fed by the second sheet supply rollers 33 to a face-down sheet discharging portion 35 therethrough.

A guide 61 is rotatably provided in the sheet guiding tray 60. When the sheet guiding tray 60 is in a position shown in FIG. 1, the guide 61 protrudes over a surface of the sheet guiding tray 60 toward the fixing unit 13. The guide 61 guides the sheet 3 fed by the second sheet supply rollers 33 to the face-down sheet discharging portion 35. A plurality of the guides 61 are provided in the width direction of the sheet 3, with a predetermined spacing therebetween.

Provided above the sheet guiding tray 60 is a pair of discharge rollers 34 that discharge the sheet 3 guided by the sheet guiding tray 60 onto the face-down sheet discharging portion 35.

The sheet 3 is discharged onto the face-down sheet discharging portion 35 to face down a side of the sheet 3 having an image formed just before the sheet 3 is discharged.

When images are printed on both sides of the sheet 3, the discharge rollers 34 are rotated opposite to the sheet feeding direction, before the sheet 3, fed by the discharge rollers 34 toward the face-down sheet discharging portion 35, is completely discharged onto the discharging portion 35. Thus, the feeding direction of the sheet 3 is reversed.

A reverse feed guiding portion 62 is provided adjacent to the discharge rollers 34. The sheet 3 is fed along the reverse feed guiding portion 62 into a reverse feeding path 63.

The reverse feeding path 63 is defined by the sheet guiding tray 60 and a rear tray 64. The rear tray 64 is rotatably provided, similar to the sheet guiding tray 60. When the rear tray 64 is in a closed position as shown in FIG. 1, the sheet 3 fed into the reverse feeding path 63 is transferred downward to a reverse feeding unit.

The reverse feeding unit includes a reverse sheet feeding guide 52 and a plurality of pairs of reverse feeding rollers 55. The reverse feeding unit conveys the sheet 3, fed through the reverse feeding path 63, to the register rollers 44, 45. The sheet 3 is further fed to the pressing portion between the photosensitive drun 21 and the transfer roller 26.

Image forming operations performed by the laser beam printer 1 according to the exemplary embodiment will be described below.

The surface of the photosensitive drum 21 is uniformly charged by the charger 25. As the surface of the photosensitive drun 21 is selectively exposed to a laser beam modulated in accordance with image information emitted from the scanner unit 11, an electrostatic latent image is formed on the surface of the drum 21. The electrostatic latent image is made visible by the toner on the developing roller 22. The visible toner image formed on the photosensitive drum 21 is carried by the photosensitive drum 21 to an image transfer position. The sheet 3 is supplied to the image transfer position, via the first sheet supply rollers 59 and the register rollers 44, 45. The visible toner image on the photosensitive drum 21 is transferred onto the sheet 3 by a transfer bias applied by the transfer roller 26. The toner remaining on the photosensitive drum 21 after an image transfer, is collected by the developing roller 22 into the developing chamber 23.

The sheet 3, fed to the fixing unit 13, is held and passed between the heat roller 32 and the pressure roller 31. Heat and pressure fuse the toner to the sheet 3, to fix the image on the sheet 3. Thereafter, the sheet 3 is conveyed by a pair of the second sheet supply rollers 33, the guide 61, the sheet guiding tray 60, and the discharge rollers 34, to the face-down sheet discharging portion 35 while making an U-turn. Thus, the image is formed on one side of the sheet 3.

When images are formed on both sides of the sheet 3, the sheet 3 is held between the discharge rollers 34 after an image is formed on one side thereof. The sheet 3, held between the discharge rollers 34, is reversely fed by the rotation of the discharge rollers 34 in the opposite direction, along the reverse feed guiding portion 62 into the reverse feeding path 63 defined by the sheet guiding tray 60 and the rear tray 64. The sheet 3 fed through the reverse feeding path 63 is guided to the reverse feeding rollers 55 by the reverse sheet feeding guide 52. The reverse feeding rollers 55 guide the sheet 3 to the register rollers 44, 45.

When the sheet 3 is reversely fed between the photosensitive drum 21 and the transfer roller 26, a side of the sheet 3 having an image formed thereon faces the transfer roller 26 and the other side having no image faces the photosensitive drum 21. An image is formed, as described above, on the side of the sheet 3 facing the photosensitive drum 21. This side of the sheet 3 faces down when discharged onto the face-down sheet discharging portion 35. The sheet 3 having images formed on both sides thereof is discharged onto the face-down sheet discharging portion 35. Thus, double-sided image forming operations are finished.

In addition to the single-sided or double-sided image forming with the face-down sheet discharge, the single-sided image forming with a face-up sheet discharge may be performed in the exemplary embodiment. Structures that enable the single-sided image forming with the face-up sheet discharge will be described below.

A manual insertion sheet tray 57 is provided on a front portion of the laser beam printer 1. The manual insertion sheet tray 57 is pivotally provided to close, or open as illustrated in FIG. 1. To form an image on a side of a special sheet, such as cardboard or an overhead transparency film that is unsuitable for a curved or U-turned feeding path and to discharge such special sheet with the printed side thereof facing up, the sheet 3 is placed on the manual insertion sheet tray 57, that is opened as shown in FIG. 1, to supply the sheet 3 therefrom.

Provided on an opposite side of the manual insertion sheet tray 57 are the rear tray 64 and the sheet guiding tray 60 that pivot about lower ends thereof.

Figure 2:
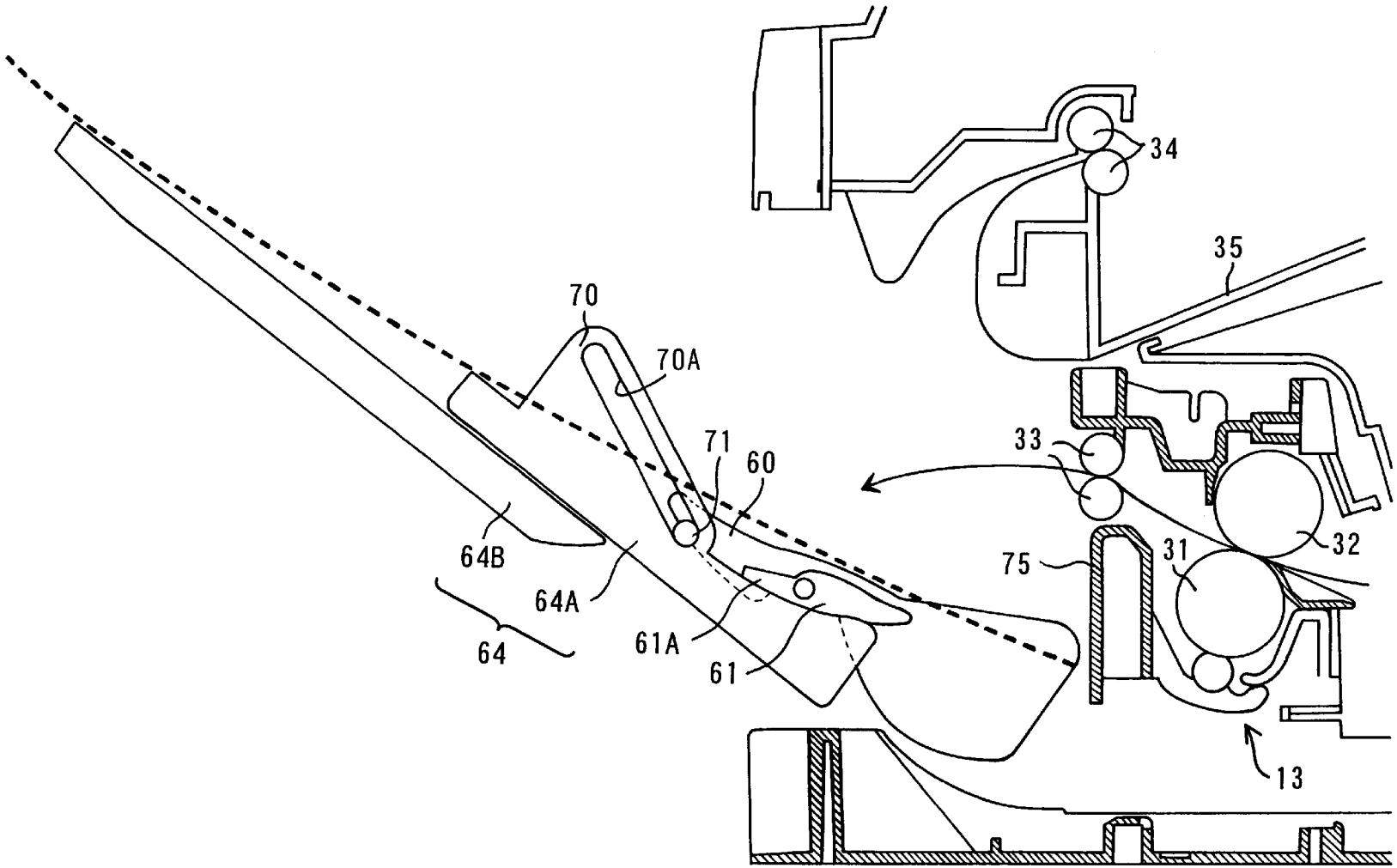
FIG. 2 is an enlarged view of a face-up sheet discharging unit of the laser beam printer shown in FIG. 1.
Figure 3B:
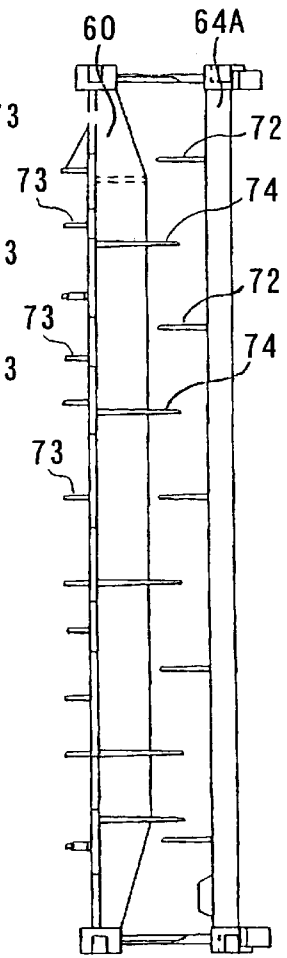
FIG. 3B is a partially side view of the face-up sheet discharging unit shown in FIG. 3A.

As shown in FIGS. 2–3B, the rear tray 64 includes a main tray 64A and an extendable tray 64B. The extendable tray 64*b* is provided to slide over the main tray 64A. By extending the extendable tray 64B, a sheet having a large size can be placed on the rear tray 64.

The rear tray 64 is integrally formed with a link plate 70 having an elongated hole 70A formed thereon, at each side of the main tray 64A. A link pin 71 that engages in the elongated hole 70A, is formed at each side of the sheet guiding tray 60. As the rear tray 64 pivots about the lower end thereof, the link pins 71 slide within the elongated holes 70A. Accordingly, the sheet guiding tray 60 is turned.

Figure 3A:
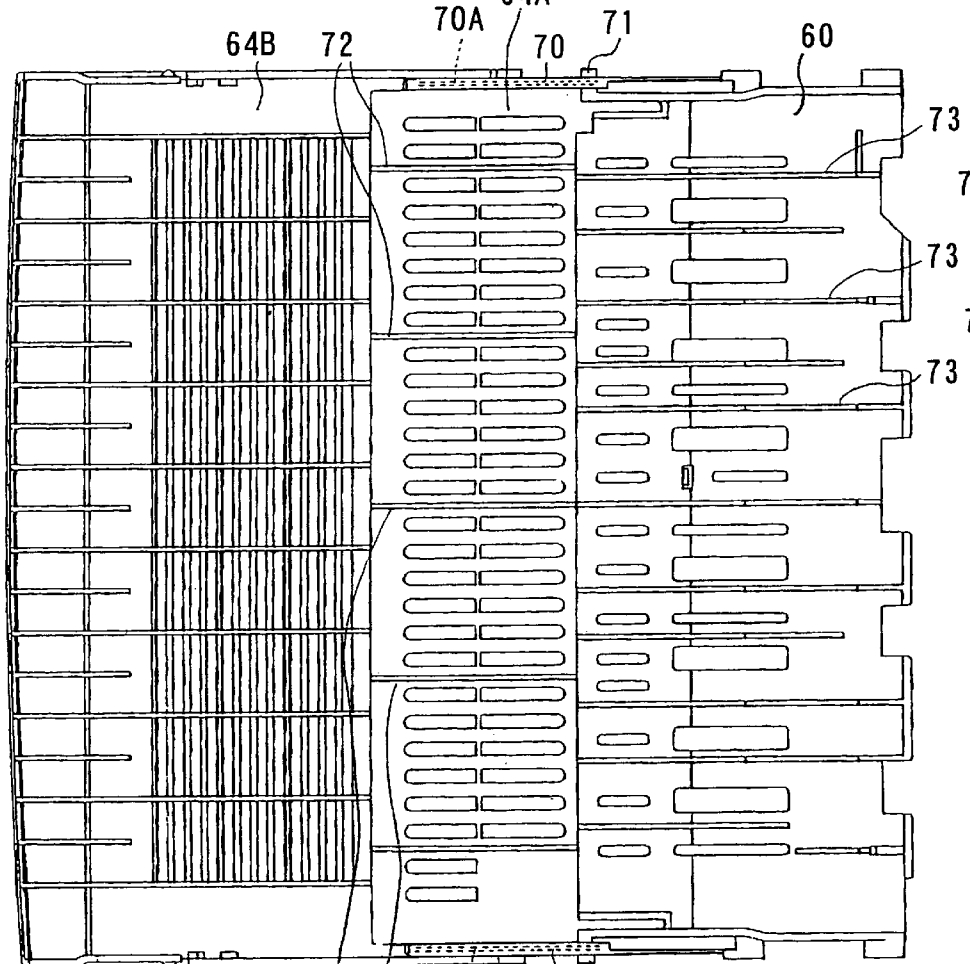
FIG. 3A is an enlarged top view of the face-up sheet discharging unit in an open state.

As shown in FIG. 3A and 3B, ribs 72 are provided, like teeth of a comb, with a predetermined spacing therebetween on the main tray 64A of the rear tray 64. Similarly, the sheet guiding tray 60 has ribs 73 provided, like teeth of a comb, with a predetermined spacing therebetween. The sheet guiding tray 60 also has ribs 74 on an opposite side of the ribs 73. The ribs 74 are provided, like teeth of a comb, with a predetermined spacing therebetween.

When the rear tray 64 and the sheet guiding tray 60 are closed as shown in FIG. 1, parts of the ribs 73 guide the sheet 3 passing through the discharge path 56, from the second sheet supply rollers 33 to the discharge rollers 34. The ribs 72 and 74 guide the sheet 3 reversely fed through the reverse feeding path 63 for double-sided printing, to sandwich the sheet 3 between the ribs 72 and 74.

When the rear tray 64 and the sheet guiding tray 60 are in an open state as shown in FIG. 2, the ribs 73 and 72 guide the sheet 3 fed by the second sheet supply rollers 33. The rear tray 64 and the sheet guiding tray 60 are positioned to keep the sheet 3 substantially flat with the ribs 72 and 73.

The ribs 74 of the sheet guiding tray 60 are disposed to interpose the ribs 72 of the rear tray 64, as shown FIG. 3B. Therefore, when the rear tray 64 and the sheet guiding tray 60 are open, the ribs 74 and 72 do not interfere with each other.

As described above, the sheet guiding tray 60 is provided with the guide 61. The guide 61 is urged by a spring (not shown) in a direction such that the guide 61 protrudes over the sheet guiding tray 60, as shown in FIG. 1. As shown in FIG. 2, the guide 61 has a lever 61A to allow the guide 61 to rotate. When the lever 61A makes contact with a part of the rear tray 64, the lever 61A rotates and is situated inward from the surface of the sheet guiding tray 60, as shown in FIG. 2. Therefore, the discharged sheet 3 may be placed substantially flat on the rear tray 64 and the sheet guiding tray 60, without being blocked by the guide 61, as shown in FIG. 2.

As the rear tray 64 is open, as shown in FIG. 2, the sheet guiding tray 60 correspondingly opens. In this state, the link plates 70 extend upwardly from a sheet guiding surface, so that the sheet 3 is discharged onto the sheet guiding tray 60 while being restricted with respect to a width direction thereof by the link plates 70.

As shown in FIG. 2, an end of the sheet guiding tray 60 is disposed adjacent to an outer wall 75 of the fixing unit 13. With this structure, the rear edge of the sheet discharged onto the rear tray 64 and the sheet guiding tray 60 is aligned by the outer wall 75.

With the above-described structures according to the exemplary embodiment, a face-up discharge path is formed by opening the rear tray 64 and the sheet guiding tray 60, as shown in FIG. 2. Thus, a generally straight discharge path is formed from the manual insertion sheet tray 57 to the sheet guiding tray 60 and the rear tray 64, for printing on thick paper, such as cardboard, or an overhead transparency film that is unsuitable for curved or U-turned feeding path.

When an image is formed on, for example, cardboard, the cardboard is inserted into the manual insertion sheet tray 57. The cardboard is fed by the first sheet supply rollers 59 and the register rollers 44, 45 between the photosensitive drum 21 and the transfer roller 26 where the toner on the photosensitive drum 21 is transferred onto the cardboard. When the cardboard, having the toner transferred thereon, passes through the fixing unit 13, the toner is fixed onto the cardboard. Thus, the image is formed on the cardboard. The cardboard having the image formed thereon is fed by the second sheet supply rollers 33 and discharged onto the rear tray 64 and the sheet guiding tray 60, with the printed side of the cardboard facing up. Because the cardboard is fed through a generally straight feeding path, the cardboard is not bent or creased while being conveyed, so that an image may be preferably formed on the cardboard. When the rear tray 64 and the sheet guiding tray 60 are open as shown in FIG. 2, the second sheet supply rollers 33 function as rollers to discharge the sheet 3 onto the rear tray 64 and the sheet guiding tray 60. When the rear tray 64 and the sheet guiding tray 60 are closed as shown in FIG. 1, the second sheet supply rollers 33 function as rollers to discharge the sheet 3 onto the face-down sheet discharging portion 35.

When the rear tray 64 and the sheet guiding tray 60 are closed as shown in FIG. 1, the reverse feeding path 63 is formed in an area that is defined by the rear tray 64 and the sheet guiding tray 60. This structure also enables the double-sided printing.

In the exemplary embodiment, the rear tray 64 defines the reverse feeding path 63 and serves as a face-up sheet discharging unit. In addition, by simply opening or closing the rear tray 64 and the sheet guiding tray 60, the double-sided printing mechanism and a face-up sheet discharging mechanism are compatibly provided.

When the rear tray 64 and the sheet guiding tray 60 are open as shown in FIG. 2, access to the fixing unit 13 becomes easier, so that maintenance of the fixing unit 13 or clearing paper jams may be easily performed.

While the invention has been described with reference to the exemplary embodiment, it is to be understood that the invention is not restricted to the particular forms shown in the foregoing exemplary embodiment. Various modifications and alterations can be made thereto without departing from the scope of the invention.

What is claimed is:

1. An image forming apparatus, comprising an image forming unit for forming an image onto a recording medium;

a supply path for supplying a recording medium to the image forming unit;

a first discharge path for discharging the recording medium from the image forming unit;

a return path, connected with the first discharge path, for returning the recording medium to the image forming unit;

a second discharge path, substantially parallel with the supply path, for discharging the recording medium; and a guide member movable from a first position to create the first discharge path and the return path to a second position to create the second discharge path, wherein the guide member comprises a first member and a second member movable relative to the first member, and the first discharge path is along a first surface of the first member and the return path is between a second surface of the first member and a first surface of the second member when the guide member is in the first position.

2. The image forming apparatus of claim 1, wherein the first surface of the first member and the first surface of the second member form a discharge member for receiving the recording medium from the second discharge path when the guide member is in the second position.

3. The image forming apparatus of claim 2, wherein the first member is a sheet guiding tray and the second member is a rear tray.

4. The image forming apparatus of claim 2, wherein a link, with an elongated hole and a pin located within the hole, is attached to the second member, the pin movable along the elongated hole to create a space between the second surface of the first member and the first surface of the second member when the guide member is in the first position and to place the second surface of the first member and the first surface of the second member adjacent to each other to form the discharge member for receiving the recording medium from the second discharge path when the guide member is in the second position.

5. The image forming apparatus of claim 2, wherein the first member includes ribs on both the first surface and the second surface.

6. The image forming apparatus of claim 2, wherein the second member includes ribs on the first surface.

7. The image forming apparatus of claim 2, wherein the first member includes ribs on both the first surface and the second surface and the second member includes ribs on the first surface with the ribs on the second surface of the first member and the ribs on the first surface of the second member interposed when the guide member is in the second position.

8. The image forming apparatus of claim 2, wherein the second member includes a lower member and an upper member, wherein the upper member is movable relative to the lower member.

9. The image forming apparatus of claim 1, wherein the guide member is rotatable along an axis from the first position to the second position.

10. The image forming apparatus of claim 1, wherein the guide member includes a guide to direct the recording medium along the first discharge path.

11. The image forming apparatus of claim 10, wherein the guide protrudes toward the image forming unit when the guide member is in the first position and is substantially parallel with the second discharge path when the guide member is in the second position.

12. The image forming apparatus of claim 1, further comprising:

a first supply tray; and a second supply tray, wherein the second supply tray is substantially parallel with the supply path.

13. The image forming apparatus of claim 12, wherein the second supply tray and the guide member are located on opposite sides of the image forming apparatus.

14. A method of forming an image by an image forming apparatus, comprising the steps of:

supplying a recording medium to the image forming apparatus along a supply path;

forming the image onto the recording medium; and discharging the recording medium to either a first discharge path, a return path connected with the first discharge path or a second discharge path substantially parallel with the supply path, wherein a guide member is movable from a first position to create the first discharge path and the return path to a second position to create the second discharge path, the guide member comprises a first member and a second member movable relative to the first member, and the first discharge path is along a first surface of the first member and the return path is between a second surface of the first member and a first surface of the second member when the guide member is in the first position.

15. The method of claim 14, wherein the first surface of the first member and the first surface of the second member form a discharge member for receiving the recording medium from the second discharge path when the guide member is in the second position.

16. The method of claim 15, wherein the first member is a sheet guiding tray and the second member is a rear tray.

17. The method of claim 15, wherein a link, with an elongated hole and a pin located within the hole, is attached to the second member, the pin movable along the elongated hole to create a space between the second surface of the first member and the first surface of the second member when the guide member is in the first position and to place the second surface of the first member and the first surface of the second member adjacent to each other to form the discharge member for receiving the recording medium from the second discharge path when the guide member is in the second position.

18. The method of claim 15, wherein the first member includes ribs on both the first surface and the second surface.

19. The method of claim 15, wherein the second member includes ribs on the first surface.

20. The method of claim 15, wherein the first member includes ribs on both the first surface and the second surface and the second member includes ribs on the first surface with the ribs on the second surface of the first member and the ribs on the first surface of the second member interposed when the guide member is in the second position.

21. The method of claim 15, wherein the second member includes a lower member and an upper member, wherein the upper member is movable relative to the lower member.

22. The method of claim 14, wherein the guide member is rotatable along an axis from the first position to the second position.

23. The method of claim 14, wherein the guide member includes a guide to direct the recording medium along the first discharge path.

24. The method of claim 23, wherein the guide protrudes toward the image forming unit when the guide member is in the first position and is substantially parallel with the second discharge path when the guide member is in the second position.

25. The method of claim 14, wherein the recording medium is supplied from either a first supply tray or a second supply tray, wherein the second supply tray is substantially parallel with the supply path.

26. The method claim 25, wherein the second supply tray and the guide member are located on opposite sides of the image forming apparatus.

* * * * *